US009950362B2

(12) United States Patent
Burada et al.

(10) Patent No.: US 9,950,362 B2
(45) Date of Patent: Apr. 24, 2018

(54) CLEAN GREEN ENERGY ELECTRIC PROTECTORS FOR MATERIALS

(75) Inventors: Venkata Burada, West Chester, OH (US); Kevin Foston, Cincinnati, OH (US)

(73) Assignee: MHI Health Devices, LLC., Cincinnati, OH (US)

( * ) Notice: Subject to any disclaimer, the term of this patent is extended or adjusted under 35 U.S.C. 154(b) by 216 days.

(21) Appl. No.: 13/513,869

(22) PCT Filed: Sep. 20, 2010

(86) PCT No.: PCT/US2010/049418

§ 371 (c)(1),
(2), (4) Date: Jun. 5, 2012

(87) PCT Pub. No.: WO2011/049698

PCT Pub. Date: Apr. 28, 2011

(65) Prior Publication Data

US 2012/0291978 A1 Nov. 22, 2012

Related U.S. Application Data

(60) Provisional application No. 61/279,180, filed on Oct. 19, 2009.

(51) Int. Cl.

| | |
|---|---|
| ***B22D 27/06*** | (2006.01) |
| ***B22D 41/015*** | (2006.01) |
| *C22B 9/22* | (2006.01) |

(52) U.S. Cl.
CPC ..... *B22D 27/06* (2013.01); *B22D 41/015* (2013.01); *C22B 9/22* (2013.01)

(58) Field of Classification Search
CPC ..... B22D 7/10; B22D 7/106; B22D 27/04; B22D 27/06; B22D 41/01; B22D 41/015
(Continued)

(56) References Cited

U.S. PATENT DOCUMENTS 1,738,600 A * 12/1929 Messler et al. ..... 249/199
1,739,222 A * 12/1929 Gathmann ..... 249/201
(Continued)

FOREIGN PATENT DOCUMENTS

FR 1008368 A * 5/1952 ..... B22D 27/06
GB 1496348 A * 12/1977 ..... B22D 7/10
(Continued)

OTHER PUBLICATIONS

"International Application Serial No. PCT/US10/49418, Written Opinion" dated Apr. 19, 2012, 3pgs.
(Continued)

*Primary Examiner* — Kevin E Yoon
*Assistant Examiner* — Jacky Yuen
(74) *Attorney, Agent, or Firm* — Michael C. Connelly

(57) ABSTRACT

A device to generate and direct electric heat 10 for use over risers, drains, pathways and pour cups during solidification in which less than 2% plasma is utilized, comprising an outer shell 20 having one open heat delivery end 25, at least one lip 30 located at the open end 25, one closed end 35, at least one electric heating element 80 affixed within the closed 35 end and refractory material 60 surrounding the electric heating element 80. A method, employing the device 10, to improve the properties of cast alloys which comprises the heating and blanketing of a molten cast surface with an atmosphere of less than 2% plasma during solidification, the atmosphere of less than 2% plasma thereby controlling temperature during the solidification and shielding the molten cast surface from the affects of oxidation.

22 Claims, 7 Drawing Sheets

(58) Field of Classification Search
USPC ..... 219/421–427, 520, 526, 531, 535, 536
See application file for complete search history.

(56) References Cited

U.S. PATENT DOCUMENTS

| | | | | | |
|---|---|---|---|---|---|
| 1,892,464 | A | * | 12/1932 | Haws | 249/198 |
| 1,990,862 | A | * | 2/1935 | Forde | A61C 13/20 164/151.4 |
| 1,997,677 | A | * | 4/1935 | Charman | 249/201 |
| 2,063,096 | A | * | 12/1936 | Heinbuch | H05B 3/06 219/205 |
| 2,152,528 | A | * | 3/1939 | Biggert, Jr. | 164/338.1 |
| 2,229,507 | A | * | 1/1941 | Johnston | 249/78 |
| 2,390,373 | A | * | 12/1945 | Jones et al. | 249/201 |
| 3,478,999 | A | * | 11/1969 | Charman, Jr. et al. | 249/201 |
| 3,502,847 | A | * | 3/1970 | Heide | 219/426 |
| 3,989,533 | A | * | 11/1976 | Jago | 501/103 |
| 4,223,873 | A | * | 9/1980 | Battles | B22D 41/015 266/281 |
| 4,365,948 | A | | 12/1982 | Chaplain | |
| 4,394,566 | A | * | 7/1983 | Magnusson | H05B 3/64 219/421 |
| 4,508,571 | A | | 4/1985 | Nakato | |
| 4,566,519 | A | | 1/1986 | Kawamura | |
| 4,694,884 | A | | 10/1987 | Butler | |
| 4,905,752 | A | | 3/1990 | Prosad | |
| 5,027,881 | A | | 7/1991 | Horst | |
| 5,053,092 | A | * | 10/1991 | Lachman | 264/638 |
| 5,263,534 | A | | 11/1993 | Ichikawa | |
| 5,607,007 | A | | 3/1997 | Chandley | |
| 5,662,218 | A | | 4/1997 | Pedroza-Conteras | |
| 5,884,687 | A | | 3/1999 | Schwartzkopf | |
| 6,133,340 | A | | 10/2000 | Menon | |
| 6,286,585 | B1 | | 9/2001 | Twardowska | |
| 6,289,898 | B1 | | 10/2001 | Mahadeva | |
| 6,446,689 | B1 | | 9/2002 | Soderstrom | |
| 6,840,062 | B1 | | 1/2005 | Dakan | |
| 6,848,496 | B2 | | 2/2005 | Ban | |
| 7,017,648 | B2 | | 3/2006 | Newcomb | |
| 7,121,323 | B2 | | 10/2006 | Weyer | |
| 7,134,478 | B2 | | 11/2006 | Ohtake | |
| 2001/0010307 | A1 | * | 8/2001 | Saito et al. | 219/390 |
| 2007/0084581 | A1 | * | 4/2007 | Graham et al. | 164/122.1 |
| 2008/0136069 | A1 | | 6/2008 | Reddy | |
| 2009/0295045 | A1 | * | 12/2009 | Akash et al. | 264/640 |

FOREIGN PATENT DOCUMENTS

| | | |
|---|---|---|
| WO | WO2011049698 | 4/2011 |
| WO | WO2011096956 | 11/2011 |

OTHER PUBLICATIONS

"International Application Serial No. PCT/US10/49418, International Preliminary Report on Patentability" dated Apr. 24, 2012, 4 pgs.

"International Application Serial No. PCT/US10/49418, International Search report" dated May 27, 2011, 4 pgs.

M.G. Fleming, Solidification Processing, 1974, McGraw-Hill, New York, pp. IX-X.

V. Rajamani, et al., Enhancement of Heat Transfer Due to Plasma Flow in Material Processing Applications, American Society of Mechanical Engineers, Heat Transfer Division, (Publication) HTD vol. 376 HTD, Issue 2, 2005, pp. 889-893.

V. Rajamani, et al., Heat-transfer enhancement using weakly ionized, atmospheric pressure plasma in metallurgical applications Metallurgical and Materials Transactions B: Process Metallurgy and Materials Processing Science vol. 37, Issue 4, Aug. 2006, pp. 565-570.

* cited by examiner

CLEAN GREEN ENERGY ELECTRIC PROTECTORS FOR MATERIALS

CROSS-REFERENCED TO RELATED APPLICATIONS

This application claims the benefit of PCT/US10/49418 filed on Sep. 20, 2010 and U.S. provisional application 61/279,180 filed on Oct. 10, 2009 by the applicants which are both incorporated by reference herein in their entireties.

BACKGROUND

Field

The present application relates to the improved control of solidification behavior during the melting and casting of metals where a clean melt and the limiting of loss of metal during the process are desired by the use of high power surface treatment.

Prior Art

Good casting or solidification processes are those in which the melt is clean during melting and casting. Presently, when castings are made the use of chills, insulation and exothermic compounds is common to affect temperature and thereby control solidification behavior. Clean melts and risers are often used for re-melts. Often, risers are heated so that the last solidification of the casting occurs at the riser top. In this application, solidification and solidification processes are used synonymously (see, for example, M. C. Fleming, *Solidification Processing*, McGraw-Hill, 1974).

Current methods for controlling solidification behavior include chills proposed in U.S. Pat. No. 7,017,648 by Newcomb et al. (2006), U.S. Pat. No. 6,840,062 by Dakan, Sr. et al. (2005), U.S. Pat. No. 6,298,898 by Mahadeva, et al. (2001), U.S. Pat. No. 5,027,881 by Horst, et al. (1991), U.S. Pat. No. 4,905,752 by Rama Prasad (1990) and U.S. Pat. No. 4,365,948 by Chaplain (1982). Also, the use of exothermic compounds to control solidification has been proposed in U.S. Pat. No. 6,446,698 by Soderstrom, et al (2002), U.S. Pat. No. 6,286,585 by Twardowska, et al (2001), U.S. Pat. No. 6,133,340 by Menon (2000), U.S. Pat. No. 5,263,534 by Ichikawa, et al. (1993), U.S. Pat. No. 4,694,884 by Butler, et al. (1987), U.S. Pat. No. 4,566,519 by Kawamura, et al. (1986) and U.S. Pat. No. 4,508,571 by Nakato, et al. (1985). Lastly, insulation in other forms employed to control solidification has been proposed by U.S. Pat. No. 7,134,478 by Ohtake, et al. (2006), U.S. Pat. No. 7,121,323 by Weyer, et al. (2006), U.S. Pat. No. 6,848,496 by Ban, et al. (2005), U.S. Pat. No. 5,884,687 by Schwarzkopf (1999), U.S. Pat. No. 5,622,218 by Pedroza-Conteras (1997) and U.S. Pat. No. 5,607,007 by Chandley (1997).

These current methods have limitations. Metal loss during oxidation is normally considerable during the manufacture of castings in air. These losses can often be the cause of impurities in re-melted alloys. Such metal loss due to oxidation is not adequately minimized by the employment of chills, insulation and exothermic compounds. Also, chemical treatments of exothermic compounds applied to surfaces may be toxic or otherwise environmentally harmful.

The use of chills and insulation may require specially designed molds and associated setting up that adds expense and time to the casting process. Often, the chills and insulation would need to be designed specifically for a specific application leading to a loss of flexibility and resulting increase in costs. Such devices may not be reusable in many cases as well, adding again to the over-all cost of the process.

It is suggested by V. Rajamani, et al., in *Enhancement of Heat Transfer Due to Plasma Flow in Material Processing Applications*, American Society of Mechanical Engineers, Heat Transfer Division, (Publication) HTD Volume 376 HTD, Issue 2, 2005, Pages 889-893 and in *Heat-transfer enhancement using weakly ionized, atmospheric pressure plasma in metallurgical applications*, Metallurgical and Materials Transactions B: Process Metallurgy and Materials Processing Science Volume 37, Issue 4, August 2006, Pages 565-570 that heat treatment employing low amounts of ions can result in cleaner aluminum and enhanced heat transfer. The present application shows that the exposure of a low-ion atmosphere to any surface, using the claimed device and method, results in cleaner surfaces and materials in general, not only aluminum, which at the time of the above articles was unanticipated.

SUMMARY

In accordance with the favored embodiment, an electric Hot Top™ for use over risers and pour cups in solidification processes including, for example, superalloy, steel, chromium, aluminum and lead castings in which less than 2% plasma is utilized, comprises an outer shell having one open heat delivery end, at least one lip located at the open end, one closed end, such outer casing containing at least one electric heating element affixed to the closed end wherein said electric Hot Top™ will prevent metal loss through oxidation thereby improving general material properties including, but not limited to, fatigue, creep, wear and erosion.

DRAWINGS—FIGURES

DRAWINGS - Reference Numbers

| | | | |
|---|---|---|---|
| 10 | electric Hot Top ™ | 20 | outer shell |
| 21 | interior | 22 | slot |
| 23 | mounting bracket | 24 | mounting bracket hole |
| 25 | open end | 26 | thermocouple |
| 30A | multiple piece lip embodiment | 30B | one piece lip embodiment |
| 31 | tooth | 32 | ring |
| 33 | screw | 34 | lip section |
| 35 | closed end | 36 | gap |
| 40 | perforated cap | 41 | bolt |
| 42 | perforation | 60 | refractory material |
| 62 | heated inner chamber | 64 | exit diameter |
| 66 | inner wall | 68 | ceiling |
| 70 | hole | 80 | heating element |
| 82 | terminal end | 84 | lug |
| 86 | connection hole | | |

DESCRIPTION—FIGS. 1, 2, 3, 4 AND 5—BEST MODE

Figure 1:
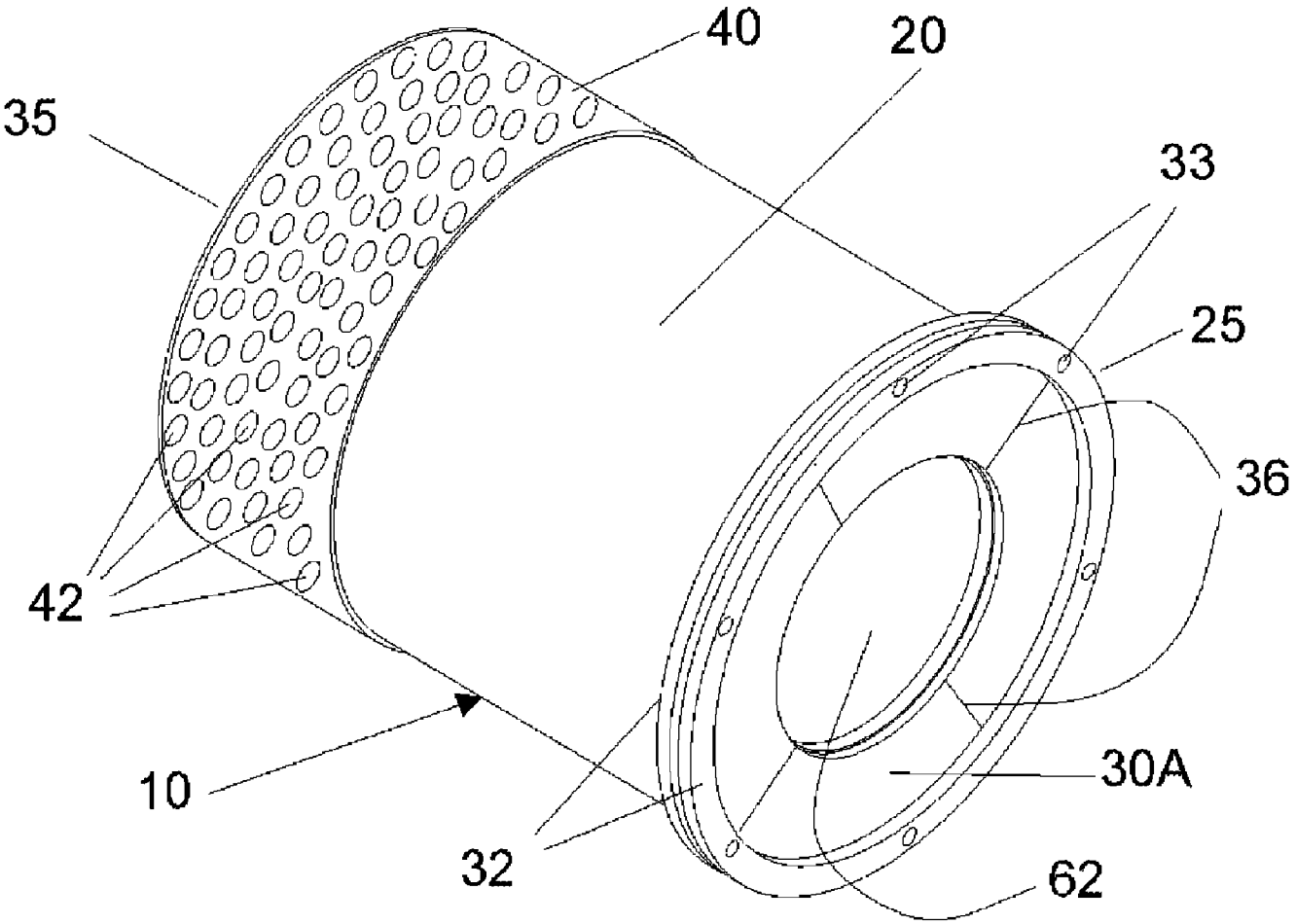
FIG. 1 is a perspective view of the electric Hot Top™ to be positioned over risers and pour cups in castings according one embodiment.
Figure 2:
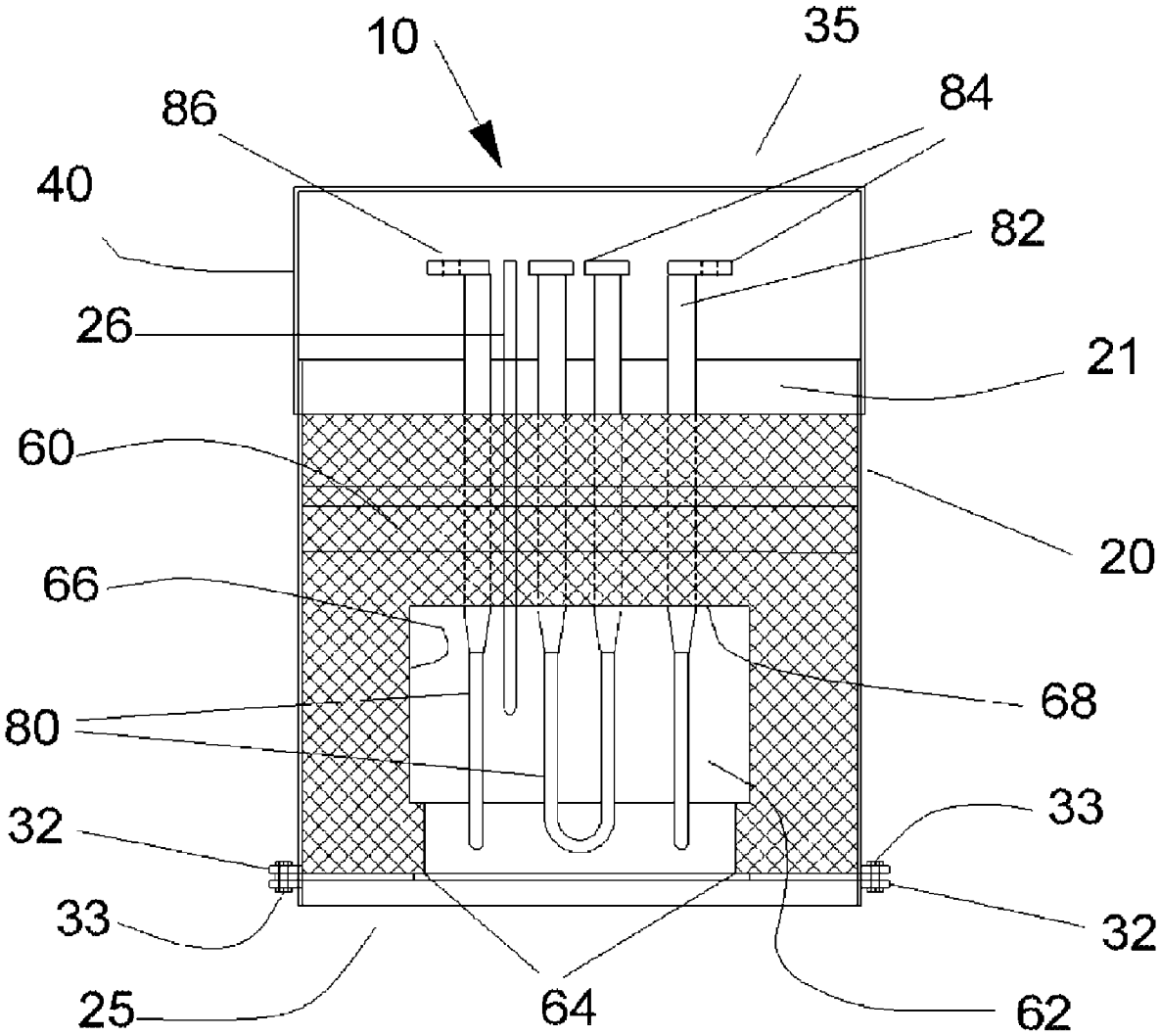
FIG. 2 is a sectional view at the diameter of the electric Hot Top™ showing the position of the heating elements, refractory material and chamber formed by the refractory material.
Figure 3:
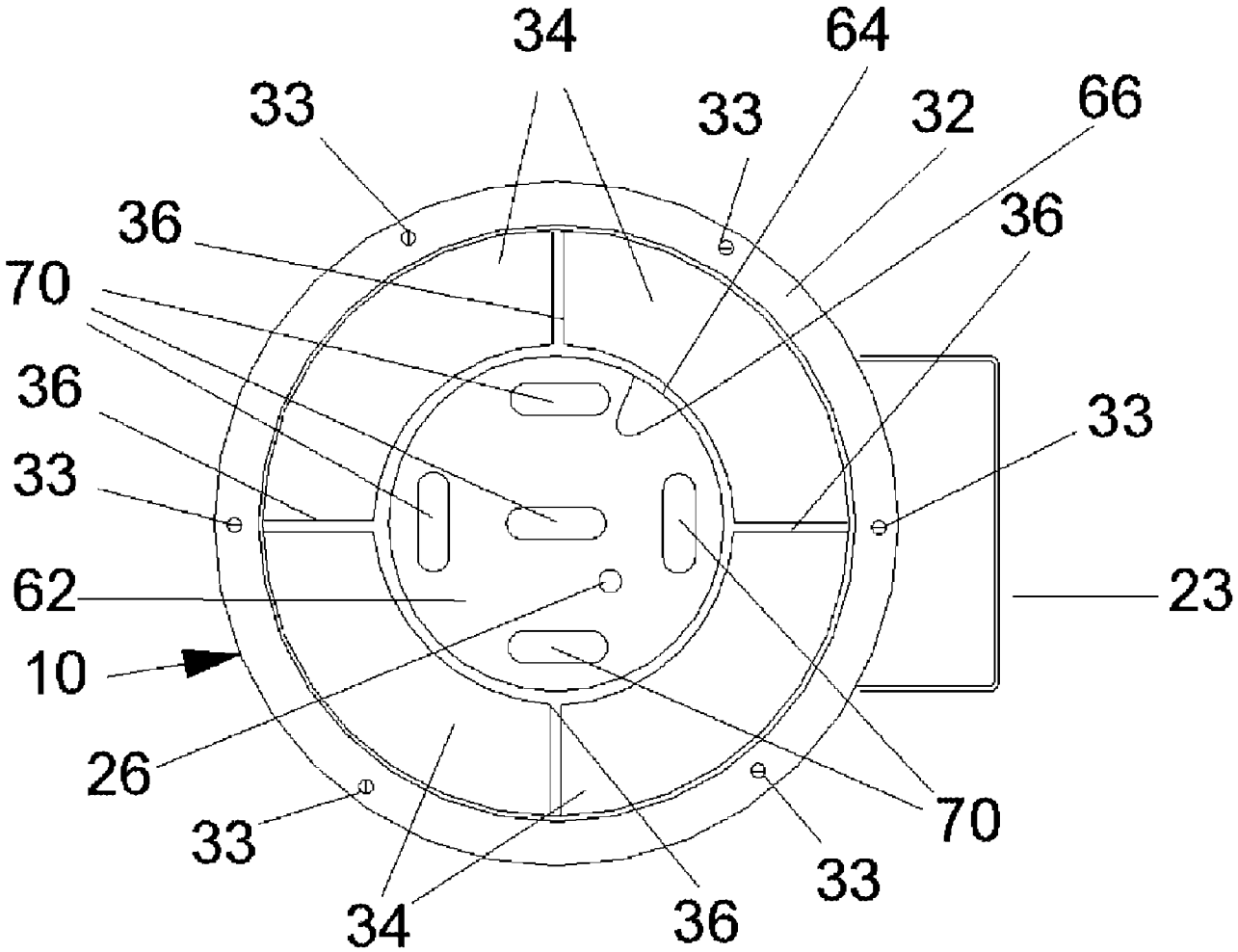
FIG. 3 is a view of the open end of the electric Hot Top™.
Figure 4:
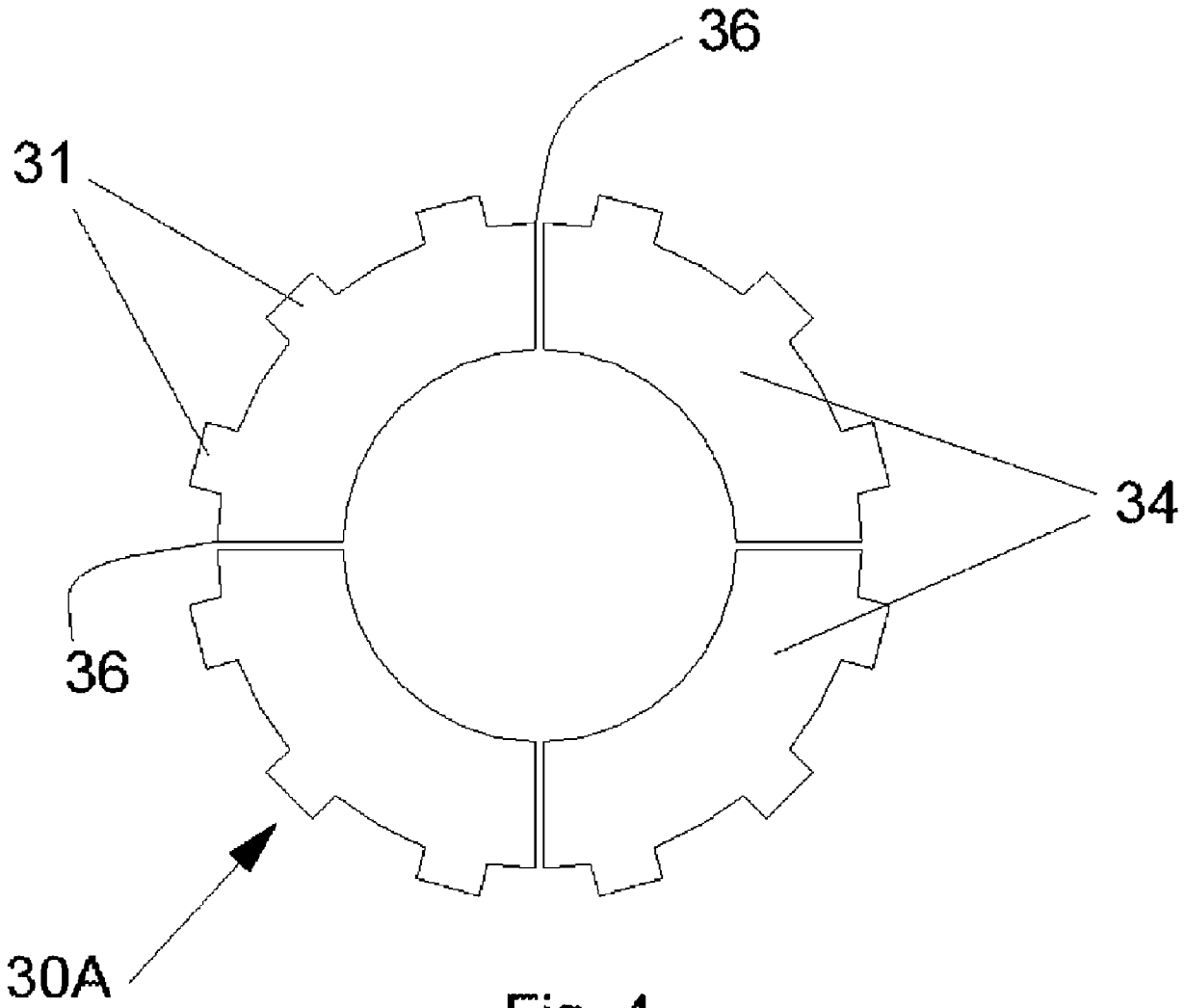
FIG. 4 is a view of the lip in a sprocket configuration divided into four sections.
Figure 5:
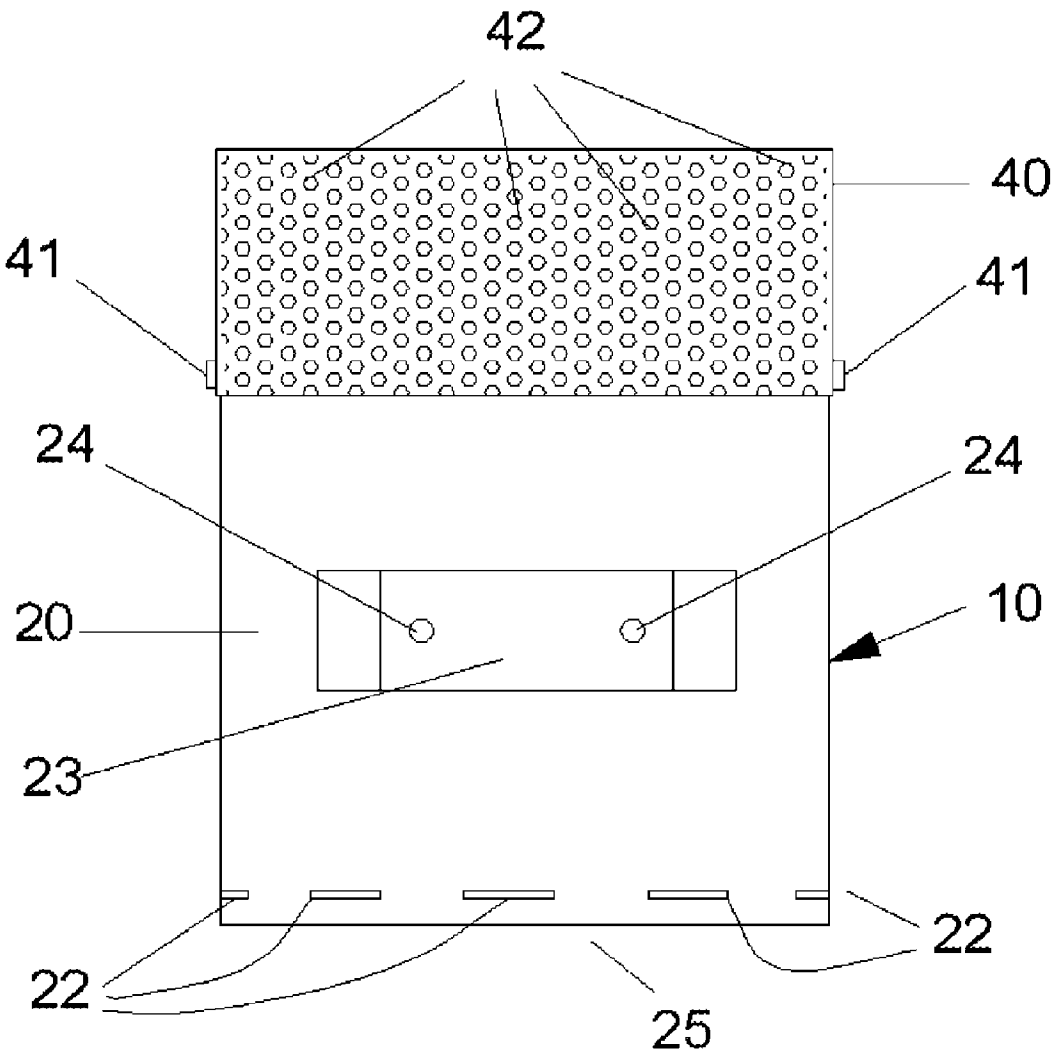
FIG. 5 is a side view of the electric Hot Top™ illustrating the position of slots near the open end.

The embodiment of the best mode of the electric Hot Top™ is illustrated in FIG. 1 (perspective view), FIG. 2 (sectional view), FIG. 3 (bottom view), FIG. 4 (top view of lip) and FIG. 5 (view showing slots). The electric Hot Top™ 10 comprises a cylindrical outer shell 20, refractory material 60 and a plurality of electrically powered and controlled heating elements 80. The outer shell 20 is typically constructed of metal having a thickness of between 1 mm and 4 mm. The outer shell 20 defines an interior 21 and is comprised of an open end 25 and a closed end 35. A perforated cap 40 is attached to the closed end 35. A lip 30A is affixed by rings 32 and a plurality of screws 33 inside the outer shell 20 near the open end 25. A mounting bracket 23 is affixed to the outer shell 20 in such a manner as to alloy the electric Hot Top™ 10 to be positioned in a great variety of configurations in proximity to a work piece as required. In this embodiment the mounting bracket 23 is configured of sheet metal in a square u-shape, the arms of the u-shape being attached to the electric Hot Top™ 10 in the direction of the axis of the outer shell 20 and perpendicular to the diameter of the outer shell 20. The mounting bracket 23 is configured with multiple mounting bracket holes 24 allowing for the mounting of the electric Hot Top™ 10 on a variety of fixtures.

In this embodiment the lip 30A is configured in a sprocket shape and composed of four equally sized lip sections 34 separated by gaps 36. The gaps 36 allow for expansion of the lip sections 34 when heated. The outer shell 20 is configured with a plurality of slots 22 through the metal thickness of the open end 25 spaced to accept the teeth 31 of the lip 30A which protrude through the outer shell 20. The slots 22 are larger than the teeth 31 allowing for expansion of the teeth 31. The rings 32 are clamped above and below the teeth 31 outside of the outer shell 20 by the plurality of screws 33 thereby holding lip 30A in place. In this embodiment, and others, the lip 30A is fabricated out of high temperature alloys including superalloys but not exclusively RA352 or Inconel type alloys.

The perforated cap 40 is fitted over the closed end 35 and extends beyond and encloses the closed end 35 of the outer shell 20. The perforated cap 40 is secured to the outer shell 20 by a plurality of bolts 41. The perforated cap 40 is pierced by a plurality of perforations 42 to provide cooling of and shielding from the heating elements 80. It is anticipated that in other embodiments the perforated cap 40 may have, but is not limited to, round perforations, hexagonal perforations or slots.

The refractory material 60 is positioned within the interior 21 of the outer shell 20 to form a cylindrical heated inner chamber 62 and is contained in place by the lip 30A as well as the outer shell 20. The ratio between the outer shell 20 and the heated inner chamber 62 is 5:3. The heated inner chamber 62 is comprised of a hot exit diameter 64 an inner wall 66 and a ceiling 68. In this embodiment the ratio of the diameter of the heated inner chamber 62 and the hot exit diameter 64 is 1:1. In other embodiments the heated inner chamber 62 may be conical in shape with the ratio between the heated inner chamber 62 and the hot exit diameter 64 ranging from 1:1 to 1:10. The refractory material 60 is composed of alternating layers of dense nano and fibrous material with high alumina content. The refractories used are a combination of nano and fibrous whose ratio is between 1:1 to 1:4 on the thickness and between 1:1 to 1:4 on the volume. In other embodiments the refractory material 60 may be castable.

Heating elements 80 project and are secured through holes 70 in the ceiling 68 of the refractory material 60 from the closed end 35 of the outer shell 20 into the heated inner chamber 62. The heating elements 80 may have compositions of, but are not limited to, silicon compounds or molybdenum disilicide. The heating elements 80 may U-shaped or square-shaped. When there are multiple heating elements 80 there may be a combination of square and U-shaped heating elements 80. In the present embodiment the heating elements 80 are five in number, U-shaped and connected electrically in series. The heating elements 80 have terminal ends 82 the opposite the U-shape or square-shape bends. The heating elements 80 and terminal ends 82 have diameters which can vary from 0.5 mm to 100 mm in diameter. Lugs 84 are affixed mechanically or by welding, brazing or gluing to the terminal ends 82 and have connection holes 86 ranging from 1.5 mm to 254 mm in diameter. The heating elements 80 are arranged with a first heating element 80 positioned through a hole 70 located in the center of the ceiling 68 and projected into the center of the heated inner chamber 62. Four other heating elements 80 are positioned symmetrically though holes 70 at 90° apart, around the first heating element 80. The holes 70 are oval in shape and are placed at approximately one inch from the inner wall 66 of the heated inner chamber 62. It is anticipated that differing numbers of heating elements 80 may be used. The construction allows for the arrangement of one to several heating elements in an energy efficient and space saving manner.

At least one thermocouple 26 is positioned through the refractory material 60 into the heated inner chamber 66 near the heating elements 80. The thermocouple 26 will read and/or control the temperature in the heated inner chamber 66. In this embodiment the thermocouple 26 is a type B, but in other embodiments the type is anticipated to be from, but not limited to, the list of J, K, T, L, N, R, P, C, Z AND MHI-E2 types. The length of the thermocouple 26 and associated wiring can vary from 25 mm to 2540 mm with the ratio of the height of the heated inner chamber 66 and the length of the thermocouple 26 being 1:1 to 1:10. The thermocouple 26 and heating elements 80 are connected permanently or non-permanently to an electric power source and controller giving versatility and flexibility to the device. A typical power supply and controller may be a three phase SCR with soft start. The thermocouple 26 may also terminals protection shield and the thermocouple compensating cable may be protected with a special high temperature sleeve and stain relief mounting.

Operation—FIGS. 1, 2, 3, 4 and 5

The electric Hot Top™ 10 is positioned in any needed orientation (horizontally, vertically, etc.) by use of the mounting bracket 23 to direct the open end 25 towards the casting or work piece in need of clean surface heating. The lip 30A may rest directly on the work piece or the electric heat generation device may be suspended above, beside or below the work piece with the mounting bracket 23. An electric current is sent through the heating elements 80 thereby generating heat that is directed from a port defined by the heated inner chamber 62 towards a heat riser, for example. Typically, for superalloy and similar metal temperature melts, a temperature beyond 1700° C. must be reached. The heating elements 80, whether in a U-shaped or a square shaped configuration, composed of silicon compounds or molybdenum disilicide are able to exceed 1850° C. in an air environment. It is expected that different sized embodiments of the electric Hot Top™ 10 will generate temperatures of >500° C., >750° C., >1000° C., >1250° C., >1500° C., >1750° C. and >2000° C. A temperature of about 1500° C. is considered particularly attractive for anticipated applications. It is fully anticipated that the low-ion atmosphere may also include other gases or solid/powders that may react to enhance the low-ion usage.

The use of the heating elements 80 fabricated of silicon compounds or molybdenum disilicide with the refractory material 60 composed of a combination of (dense) nano and fibrous refractory material creates the conditions needed for a very clean melt. The distance that the thermocouple 26 is placed from the casting or the melt is very critical and can range from 12.5 mm to 2540 mm A small blanket of ionization is produced by these heating elements 80 and their positioning in this type of refractory material 60. The ionization is typically less than 2% of the total atmosphere with the inner heated chamber 62. The blanketing of a casting with ionization results in a clean melt with less material wastage than current methods utilizing exothermic compounds, chills and insulation.

Figure 6:
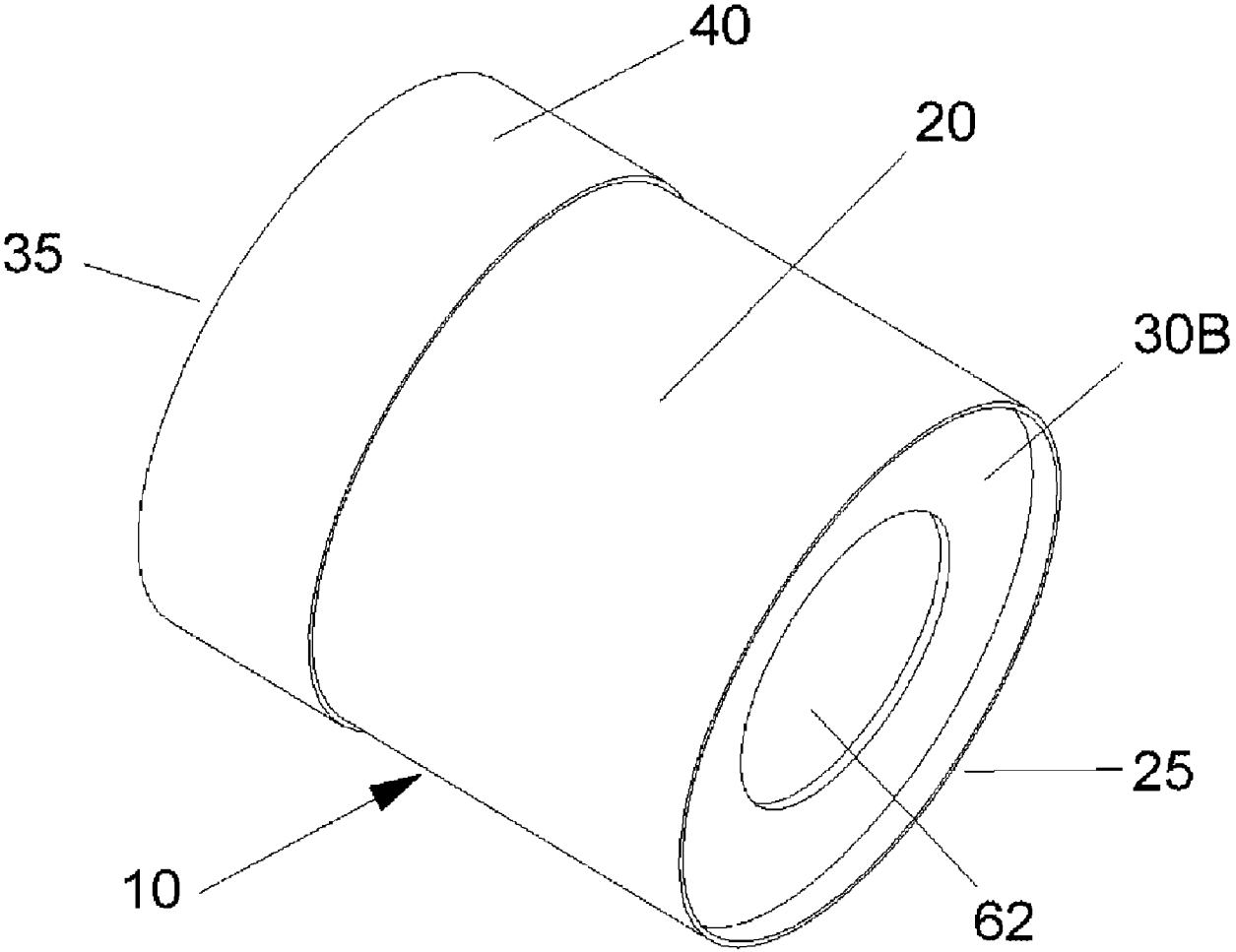
FIG. 6 is a perspective view of an alternate embodiment of the electric Hot Top™.
Figure 7:
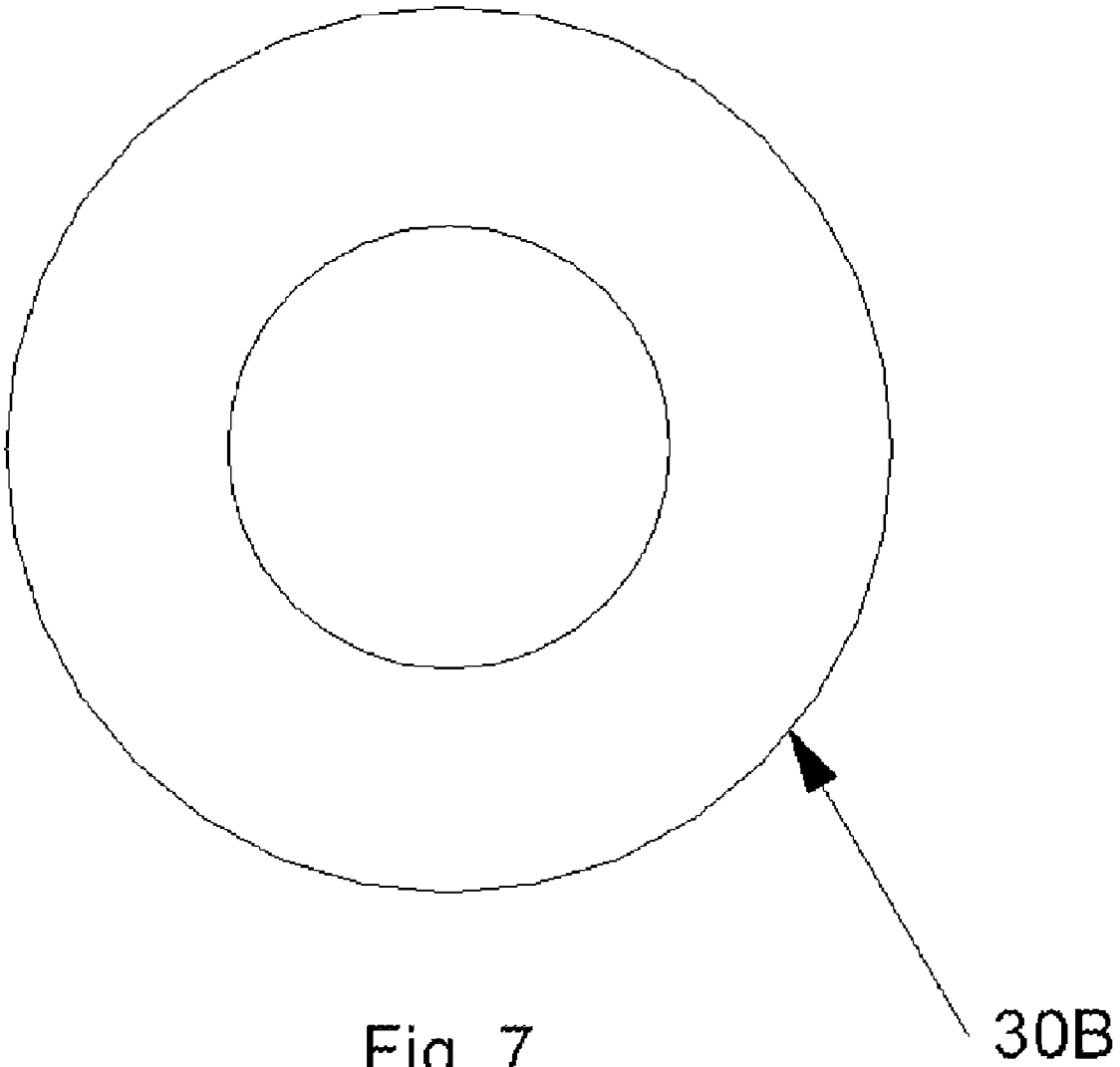
FIG. 7 is a view of the lip in a circular one piece configuration.

Alternate Embodiment—FIGS. 6 and 7

Illustrated in FIGS. 6 and 7 is an alternate embodiment of the electric Hot Top™ 10 having a lip 30B which is of one piece construction and having a circular shape. The lip 30A is secured to interior of the outer shell 20 of the electric Hot Top™ 10. This embodiment gives the outer shell 20 of the electric Hot Top™ 10 a more streamlined surface by eliminating the slots 22, rings 32 and screws 33 depicted in FIGS. 1, 2, 3, 4 and 5.

Advantages

While fully realizing there are many other advantages provided by the electric Hot Top™ 10, from the description above, a number of advantages of the embodiments of the electric hot top become evident including:

(a) The use of the electric Hot Top™ 10 allows for a cleaner melt resulting in less wastage of material and better material properties, such as creep, fatigue and overall reliability of cast parts. The low-ion atmospheres utilized here are superior to a high-ion atmosphere since low amounts of ions are controllable, and, in effect, beneficially catalyze reactions on a surface or in a gas-ion mixture while high amounts of ions are not controllable and can detrimentally melt and damage surfaces.

(b) Electric heat employed in such as manner is environmentally safer than the current practice of using exothermic compounds, which may be toxic, to control cooling in castings. Electric heat is more efficient and also does not produce the hydrocarbons and pollution associated with gas and open flame heat sources. The electric Hot Top™ 10, as a result, is greener than current products.

(c) The embodiments presented here show the versatility of the electric Hot Top™ 10. The electric Hot Top™ 10 may be configured for the specific needs of the user. Different configurations, numbers and materials can be used in regards to the heating elements 80 allowing for varying temperature and power usage. Size and configuration of the perforated cap 40 is variable to allow for more cooling or spatial constraints. The design of the refractory material 60 can be tailored for density and heat loss requirements. The dimensions of the heated inner chamber 62 can be altered to give a different ration between the heated inner chamber itself and the exit diameter 64 allowing the electric heat to be more effectively directed.

(d) Lip 30A and 30B permit the electric Hot Top™ 10 to be place directly upon a work piece such as a pour cup thereby efficiently directing the heat where needed. Lip 30A has the further advantage, in conjunction with slots 22, rings 32 and screws 33 of being easily replaceable in case of oxidation, damage or changing needs. The gaps 36 approximately measure between 2 and 10 millimeters, depending on the radius and the thickness of the lip 30A, and permit expansion of the lip sections 34 upon heating. Due to extreme temperature variations between surfaces and assemblies of greater than 1000° C., gaps 36 between the lip sections 34 are necessary to permit expansion which allows the device to survive the stresses created by these temperature differentials.

CONCLUSIONS, RAMIFICATIONS AND SCOPE

The present application, the CLEAN and GREEN ENERGY electric Hot Top™ (trademark of MHI, Inc.), is a new electric heater which can be employed to direct energy to the surface of a casting in a manner so as to be considered an electric heat generator usable instead of exothermic compounds. The Hot Top™ directly supplies heat produced by the recombination of ions in a blanketing of a work-piece in low-ion plasma atmosphere as well as through radiative processes. The major heat transfer of this device occurs via radiation and ion recombination. Minor heat transfer is accomplished by natural convection as opposed to the co-filed PCT patent application no. PCT/US10/49421 entitled "Anti-Smudging, Better Gripping, Better Shelf-Life of Products and Surfaces" which mostly utilizes forced convection for heat transfer with radiation as a minor contributor. It is designed to be employed for long-term exposures of materials. Experience has indicated that different emissivities of the surfaces inside of the device may have a stabilizing effect on the low-ion atmosphere leading to improved performance. The use of the electric Hot Top™ alleviates the stated prior art problems of impurities and metal loss due to oxidation associated with the current state of the art in casting and the control of solidification behavior as well as having additional advantages. It may be employed for melt cleaning, metal cleaning and metal grain and the enhancing of microstructures.

An initial, significant advantage of the electric Hot Top™ is that it can provide heat to any desired area of the casting and casting process itself including the pouring sprue/cup, risers, holders, as well as the liquid material itself, during the solidification process giving greater flexibility over current methods. The device can be placed directly on the pour cup, casting or other work-piece and it can be positioned and mounted vertically, horizontally or diagonally. It can be oriented upside-down, right side-up or sideways according to need. Placement may also be in close proximity rather than in contact with a work-piece. This versatility offers much better control and thermal management than do current methods.

The electric Hot Top™, relying on electric heat, produces a clean heat that is more energy efficient than current non-electric processes, without the toxic, noxious and environmentally hazardous results associated with chemicals and exothermic compounds. Electrically powered heating elements, as employed here, are superior to other heating methods that include steam, flame, gas, combustible mixtures, vacuum and semi-vacuum processes by being cleaner, safer, more versatile, more flexible, more environmentally compatible, more controllable and more efficient. The clean material produced leads to improved fatigue and creep properties in metals as well as increased overall reliability of products produced utilizing clean heat as produced by the electric Hot Top™. Although major advantages of the electric Hot Top™ over the prior art include non-toxicity and ease of operation it may be employed in conjunction with exothermic compounds and chills. It is also anticipated that it may be used in environments other than air including, but not limited to, vacuum and vapor (metal, polymer etc.) and during changing atmospheric conditions.

The advances in the field of art provided by the electric Hot Top™ rely on the key discovery that a clean melt is produced by the blanketing of the surface of the casting by small amount of ionization that is specially created by molysilicde heating elements and a combination of (dense) nano and fibrous refractories (see U.S. Pat. No. 6,113,802 by Penumella (2000)). Typically, less than 2% of the total atmosphere within the space formed by the top surface of the casting and the interior chamber of the electric hot top is composed of plasma, which is a partially ionized gas, having a percentage of charged particles. Here, when employing the word plasma it is interchangeably used with ions and ion and non-ionized gasses. The overall ion content may be less than 10%, 1% or even 0.1%. It is estimated that the blanketing of the surface of the casting by the plasma will result in a cast metal wastage savings of 0.1-1%, 1-10% or 20-50% as well as a reduced contamination of the melt (see U.S. Patent Application Publication 2008/136069 by Reddy (2008)).

Several designs of the electric Hot Top™ have been developed and fabricated which have been employed during superalloy casting producing superior casting results with low metal loss. The term superalloy is considered to encompass all high temperature metallic alloys containing predominantly iron, aluminum, chromium or nickel. Although clean castings with low metal loss have been obtained in the casting of superalloys while utilizing the electric Hot Top™ it is anticipated that similar excellent results will be achieved for castings of all nickel, iron, aluminum, chromium, tungsten and other metals and in other solidification methods such as equiaxed casts, directional solidification, investment casting, lost wax processes, polyurethane and similar polymer casting, and other currently employed discreet and continuous types of casting processes. The cleanliness of melt offered by the electric Hot Top™ improves a broad class of mechanical properties including fatigue, wear, creep and creep-fatigue for specific alloys at high temperatures. Although the device is predominately electrically radiant, it should be made clear that ion transfer by natural and forced convective conduction are also anticipated.

Accordingly, it is demonstrated that the electric heat generating process for use with metal casting provided by the electric Hot Top™ 10 provides many important advantages over current practice. It is versatile since it can be designed in many configurations and employed in many applications specific to a user. Due to the combination of refractory material 60 with high alumina content and heating elements 80 made of molybdenum disilicide or silicon compounds, the electric Hot Top™ 10 generates an electric heat that is composed of less than 2% plasma producing a superior clean melt.

The above descriptions provide examples of specifics of possible embodiments of the electric Hot Top™ and should not be used to limit the scope of all possible embodiments. Thus the scope of the embodiments should not be limited by the examples and descriptions given, but should be determined from the claims and their legal equivalents.

What is claimed is:

1. A device to generate and direct electric heat for use over risers, drains, pathways and pour cups during solidification in which less than 2% plasma is utilized, comprising a one piece outer shell having one open heat delivery end, wherein the outer shell defines a shell opening at the open heat delivery end and the shell has a thickness, at least one lip attached to the outer shell located at the open end, wherein the shell has a plurality of slots through the thickness of the shell, wherein the at least one lip projects horizontally from the outer shell, in line with the plurality of slots, into the shell opening and is recessed within the shell opening away from the open end, one closed end, at least one electric heating element affixed within the closed end and refractory material, wherein the refractory material defines a part of an inner chamber, the inner chamber having an exit diameter that opens the inner chamber to outside of the device wherein the exit diameter is ringed by the at least one lip, positioned at the open heat delivery end of the outer shell, into which the at least one electric heating element projects, wherein the heating element is directly exposed to an atmosphere in the inner chamber.

2. The device of claim 1 wherein the lip is configured to contain the refractory material within the outer shell.

3. The device of claim 1 further comprising multiple heating elements.

4. The device of claim 1 wherein the electric heating element is composed of molybdenum disilicide.

5. The device of claim 1 wherein the electric heating element is composed of a silicon compound.

6. The device of claim 1 wherein the electric heating element is configured in a u-shape or a square shape.

7. The device of claim 1 further including at least a second heating element connected in series with the first heating element.

8. The device of claim 7 wherein the electric heating elements are composed of a combination of u-shaped and square shaped configurations.

9. The device of claim 1 wherein the at least one electric heating element located within the outer shell is surrounded by alternating layers of dense nano refractory and fibrous refractory material.

10. The device of claim 9 wherein the alternating layers of the nano refractory and the fibrous refractory each have a thickness and a volume, wherein there is present a ratio by volume and by thickness of the dense nano refractory and the fibrous refractory between 1:1 and 1:4.

11. The device of claim 1 wherein the outer shell forms an outer diameter and wherein the refractory material surrounding the heating element form an inner chamber having an inner diameter such that the ratio of the outer diameter and the inner diameter is 5:3.

12. The device of claim 1 wherein the outer shell and the lip are constructed of a metal of a thickness between 1 and 4 millimeters and wherein the metal is composed of a high temperature alloy, the high temperature alloys including, but not limited to, superalloys, Ni-based alloys, Cr-based alloys or Fe-based alloys.

13. The device of claim 1 wherein the lip is divided into at least four equal or unequal lip sections, the lip sections being separated by a plurality of gaps which allow for expansion of the lip sections.

14. The device of claim 13 wherein the gaps are about 2 to 10 millimeters in width.

15. The device of claim 1 wherein the at least one heating element projects out of the outer shell through the closed end.

16. The device of claim 15 further comprising a cap affixed to the closed end, wherein the cap encloses the at least one heating element projecting out of the closed end.

17. The device of claim 16 wherein the cap is perforated.

18. The device of claim 1 wherein the at least one lip is removable from the outer shell.

19. The device of claim 1 wherein the lip is completely circular in shape.

20. The device of claim 1 wherein the lip is in the shape of a sprocket wherein the sprocket has a plurality teeth projecting from its outer edge.

21. The device of claim 20 wherein the plurality of teeth of the sprocket project through the plurality of slots of the shell.

22. The device of claim 21 further comprised of a means to secure the lip in its position within the shell from the outside of the shell by attachment to the plurality of teeth projecting out of the plurality of slots.

* * * * *